US009210512B2

(12) United States Patent
Kim

(10) Patent No.: US 9,210,512 B2
(45) Date of Patent: Dec. 8, 2015

(54) FLAT-TYPE SPEAKER HAVING PLURALITY OF MAGNETIC CIRCUITS WHICH ARE HORIZONTALLY CONNECTED

(75) Inventor: Dong-Man Kim, Seoul (KR)

(73) Assignee: EXELWAY, INC., Seoul (KR)

( * ) Notice: Subject to any disclaimer, the term of this patent is extended or adjusted under 35 U.S.C. 154(b) by 0 days.

(21) Appl. No.: 14/234,047

(22) PCT Filed: Jun. 8, 2012

(86) PCT No.: PCT/KR2012/004486

§ 371 (c)(1),
(2), (4) Date: Jan. 21, 2014

(87) PCT Pub. No.: WO2012/169792

PCT Pub. Date: Dec. 13, 2012

(65) Prior Publication Data

US 2014/0161303 A1 Jun. 12, 2014

(30) Foreign Application Priority Data

Jun. 8, 2011 (KR) ..... 10-2011-0055237

(51) Int. Cl.
*H04R 1/00* (2006.01)
*H04R 9/06* (2006.01)
(Continued)

(52) U.S. Cl.
CPC ..... *H04R 9/025* (2013.01); *H04R 9/047* (2013.01); *H04R 7/04* (2013.01); *H04R 7/045* (2013.01);
(Continued)

(58) Field of Classification Search
CPC ..... H04R 9/025; H04R 9/027; H04R 7/04; H04R 7/045; H04R 7/06; H04R 7/08; H04R 7/10; H04R 9/00; H04R 29/003; H04R 2209/00; H04R 2209/041; H04R 2440/00; H04R 2440/01; H04R 2440/03; H04R 2440/05; H04R 2440/07
USPC ..... 381/152, 400, 401, 412, 421, 431
See application file for complete search history.

(56) References Cited

U.S. PATENT DOCUMENTS

2002/0118847 A1 8/2002 Kam
2002/0172392 A1 11/2002 Iwasa et al.
(Continued)

FOREIGN PATENT DOCUMENTS

EP 2701403 2/2014
KR 20100011199 2/2010
(Continued)

OTHER PUBLICATIONS

English Abstract of KR 20100011199.
(Continued)

*Primary Examiner* — Matthew Eason
*Assistant Examiner* — Sean H Nguyen
(74) *Attorney, Agent, or Firm* — Preston Smirman; Smirman IP Law, PLLC

(57) ABSTRACT

The present invention relates to a flat-type speaker, and more specifically, to a flat-type speaker in which a plurality of magnetic circuits are horizontally connected in serial or in parallel such that one speaker is formed. According to the present invention, a flat-type speaker in which a plurality of magnetic circuits are horizontally connected is constituted by: a horizontal connection structure in which two or more pairs of independent magnetic bodies having different polarities are equipped; on said two or more magnetic bodies, enabling two or more voice coil plates, on which voice coils are printed, to be vertically arranged between the respective magnetic bodies in a horizontal direction; enabling the stream of currents of said two or more voice coil plates to maintain the same direction; allowing two or more thin film-shaped vibration-lead plates to be positioned on the upper end of said two or more voice coil plates such that the plates are electrically separated from each other; and allowing said voice coils and said two or more vibration-lead plates to be electrically connected with each other.

11 Claims, 5 Drawing Sheets

(51) Int. Cl.

| | |
|---|---|
| ***H04R 11/02*** | (2006.01) |
| ***H04R 9/02*** | (2006.01) |
| ***H04R 9/04*** | (2006.01) |
| *H04R 7/08* | (2006.01) |
| *H04R 29/00* | (2006.01) |
| *H04R 7/04* | (2006.01) |
| *H04R 9/00* | (2006.01) |
| *H04R 7/06* | (2006.01) |
| *H04R 7/10* | (2006.01) |

(52) U.S. Cl.

CPC ... *H04R 7/06* (2013.01); *H04R 7/08* (2013.01); *H04R 7/10* (2013.01); *H04R 9/00* (2013.01); *H04R 9/027* (2013.01); *H04R 9/06* (2013.01); *H04R 29/003* (2013.01); *H04R 2209/00* (2013.01); *H04R 2209/041* (2013.01); *H04R 2440/00* (2013.01); *H04R 2440/01* (2013.01); *H04R 2440/03* (2013.01); *H04R 2440/05* (2013.01); *H04R 2440/07* (2013.01)

(56) References Cited

U.S. PATENT DOCUMENTS

| | | | | |
|---|---|---|---|---|
| 2007/0076915 | A1* | 4/2007 | Shin et al. | 381/400 |
| 2008/0205686 | A1 | 8/2008 | Tagami et al. | |
| 2010/0215208 | A1* | 8/2010 | Sadaie et al. | 381/407 |
| 2011/0051987 | A1* | 3/2011 | Ueda et al. | 381/412 |
| 2012/0008816 | A1* | 1/2012 | Liu et al. | 381/401 |

FOREIGN PATENT DOCUMENTS

| | | |
|---|---|---|
| WO | 2005055646 | 6/2005 |
| WO | 2011029872 | 3/2011 |

OTHER PUBLICATIONS

European Search Report for EP 12797627.2, Oct. 20, 2014.

* cited by examiner

FLAT-TYPE SPEAKER HAVING PLURALITY OF MAGNETIC CIRCUITS WHICH ARE HORIZONTALLY CONNECTED

CROSS-REFERENCE TO RELATED APPLICATION

The instant application is a national phase of PCT International Application No. PCT/KR2012/004486, filed on Jun. 8, 2012, and claims priority to Korean Patent Application Serial No. 10-2011-0055237, filed Jun. 8, 2011, the entire specifications of both of which are expressly incorporated herein by reference.

TECHNICAL FIELD

The present invention relates to a flat-type speaker and, more particularly, to, a flat-type speaker in which a plurality of magnetic circuits is horizontally connected in series or in parallel to form one speaker.

BACKGROUND ART

A speaker includes a voice coil plate and a diaphragm interposed between magnets, and the diaphragm is vibrated by movements of the voice coil plate, thereby generating sounds.

The voice coil plate used in the flat-type speaker is wound on a single side or on both sides of a plate-type coil base into an oval shape or pattern-printed.

When an electric current flows through the voice coil of the voice coil plate, the flowing current generates a magnetic field that is expanded and contracted in the same frequency as an audio signal around the voice coil. Since a magnetic field generated from the magnets within a speaker unit is applied to the voice coil, the magnetic field generated from the magnets interacts with the magnetic field generated from the voice coil and thus the voice coil plate moves up and down. Since the voice coil plate is connected to the diaphragm of the speaker unit, the diaphragm moves up and down and pushes air, with the result that sounds are generated by the vibration of the air.

Such a flat-type speaker has been developed to have a gradually slim size and long structure along with an increase of an output capacity. Furthermore, in order to increase the output capacity of the flat-type speaker, the development of a flat-type speaker configured to have a plurality of magnetic circuits combined is gaining strength as an important problem.

DISCLOSURE

Technical Problem

The present invention has been made to solve the above problems, and an object of the present invention is to propose a flat-type speaker in which a plurality of magnetic circuits has been horizontally combined.

Furthermore, in a flat-type speaker having a structure in which two or more independent magnetic bodies with different polarities are horizontally connected, a high-output flat speaker in which a plurality of voice films placed in each of the independent magnetic bodies has the same current flow direction and a plurality of magnetic circuits is provided at the bottom of one large and wide diaphragm is to be implemented in order to increase the total amount of energy and achieve a significantly thin thickness.

Technical Solution

In a flat-type speaker in which a plurality of magnetic circuits is horizontally connected according to the present invention for achieving the above objects, two or more pairs of independent magnetic bodies with different polarities are horizontally connected, each of two or more voice coil plates having voice coils printed thereon is horizontally arrayed between the magnetic bodies in a vertical direction in the two or more magnetic bodies, the two or more voice coil plates maintain an identical current flow direction, two or more vibration-lead plates of a slim and thin film shape are electrically separated from each other and placed on top of the two or more voice coil plates, and the voice coils and the two or more vibration-lead plates are electrically connected.

Here, power source terminals for applying a power source preferably are formed at both ends of two vibration-lead plates that belong to the two or more vibration-lead plates.

Here, the two or more vibration-lead plates preferably include a pair of the vibration-lead plates, and each of the pair of vibration-lead plates preferably includes a contact spline electrically connected to the voice coil, a vibration spline brought in surface-to-surface contact with a diaphragm placed on the upper side of the vibration-lead plates, and a wing spline connecting the contact spline and the vibration spline.

Here, the two or more vibration-lead plates preferably include respective contact splines electrically connected to the voice coils of the two or more voice coil plates, respective vibration splines brought in surface-to-surface contact with a diaphragm placed on the upper side of the vibration-lead plates, and respective wing splines connecting the contact splines and connecting the vibration splines.

Here, the flat-type speaker in which the plurality of magnetic circuits is consecutively connected preferably further includes one or more connection lead plates. The two or more vibration-lead plates preferably includes contact splines electrically connected to respective voice coils in response to the two or more voice coil plates, respectively, vibration splines brought in surface-to-surface contact with a diaphragm placed on the upper side of the two or more vibration-lead plates, and wing splines connecting the contact splines and the vibration splines. The one or more connection lead plates preferably include a first serial contact spline electrically connected to the voice coil of one voice coil plate, a second serial contact spline electrically connected to another voice coil plate adjacent to the one voice coil plate, and a bridge spline connecting the first and the second serial contact splines.

Here, the connection terminal of a copper thin plate form preferably is formed at a portion where the two or more vibration-lead plates and the voice coils are electrically connected.

Here, the bottom of the two or more voice coil plates preferably is mounted on seating portions placed in a vertical central part of a rectangular damper, and the outskirt of the damper preferably is mounted on a damper guide formed at the outskirt of the bottom of a base frame that form an outward appearance.

Advantageous Effects

In accordance with the aforementioned structure of the present invention, a high-output flat-type speaker having a structure in which 2 or more pairs of independent magnetic bodies with different polarities are horizontally connected at the bottom of one large and wide diaphragm is implemented.

Accordingly, a high-output problem in a single-structured flat-type speaker can be overcome.

Furthermore, productivity and a reduction of a failure rate can be significantly improved by obviating wires and lead lines within the flat-type speaker unit.

As a result, the greatest disadvantages of a current high-output speaker include that volume is large and a wide installation place is necessary. In contrast, the present invention can implement a frame-type high-output flat-type speaker in addition to a wall-mount type speaker because the thickness of a high-output flat-type speaker can be significantly reduced.

Furthermore, a slim and flat high-output flat-type speaker can be developed because more sound energy is transferred to the diaphragm through the up and down vibration of the horizontally connected magnetic circuit and voice film and a surface-to-surface contact between the vibration-lead plate and the diaphragm.

11, 31, 51: base frame
12*a*, 12*b*, 32*a*, 32*b*, 62*a*, 62*b*: magnetic body
13*a*, 13*b*, 33*a*, 33*b*, 53*a*, 53*b*, 63, 73: voice coil plate
14*a*, 14*b*, 34*a*, 34*b*: vibration-lead plate
15, 35: diaphragm 16, 36, 56: damper
51*a*: damper guide 56*a*: damper bridge
56*b*: seating portion

MODE FOR INVENTION

The structures and acting effects of a flat-type speaker configured to have a plurality of magnetic circuits horizontally connected according to the present invention are described in detail below with reference to the accompanying drawings.

A plurality of magnetic circuits described herein means a case where voice coil plates having a voice coil printed thereon are 2 or more, a flat-type speaker shown in FIGS. 1 to 4 and described as preferred embodiments corresponds to a case where two voice coil plates (or magnetic circuits) are horizontally placed, and a case where three or more voice coil plates (or magnetic circuits) are horizontally placed may be described in accordance with the same principle.

A structure in which two or more voice coils (magnetic circuits) are electrically connected uses a vibration-lead plate and is a structure in which the plurality of magnetic circuits is connected in parallel or in series by connecting the vibration-lead plate and the voice coils. The parallel connection structure of the plurality of magnetic circuits is described with reference to FIGS. 1 and 2, and an example of the serial connection structure is described with reference to FIGS. 3 and 4.

Figure 1:
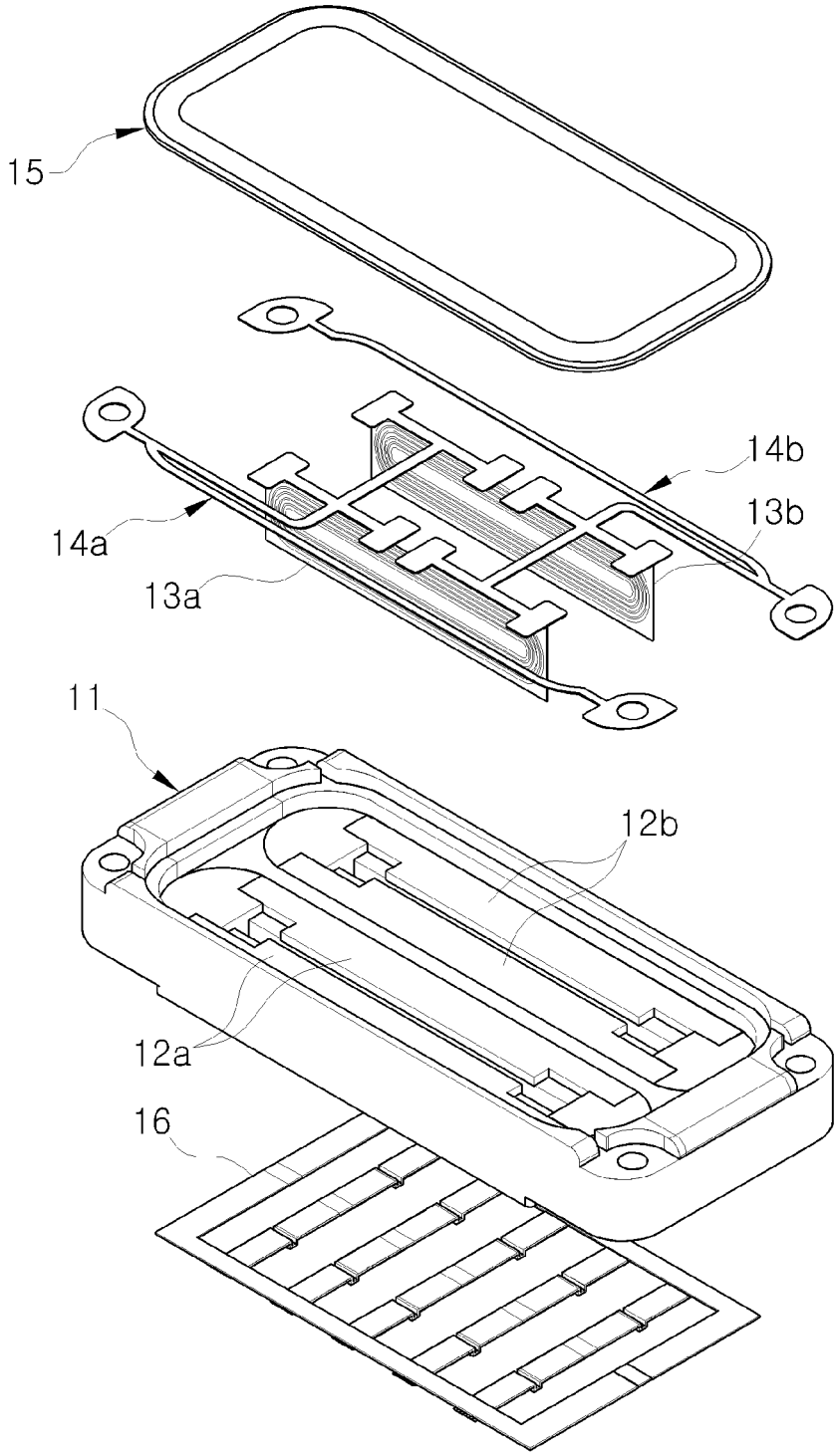
FIG. 1 is an exploded perspective view showing a parallel connection structure of a flat-type speaker in which a plurality of magnetic circuits is horizontally connected in accordance with a first embodiment of the present invention.

A parallel connection structure of a flat-type speaker in which a plurality of magnetic circuits is horizontally connected FIG. 1 is an exploded perspective view showing a parallel connection structure of a flat-type speaker in which a plurality of magnetic circuits is horizontally connected in accordance with a first embodiment of the present invention.

As shown in FIG. 1, the flat-type speaker in accordance with the first embodiment of the present invention is configured to include a base frame 11, magnetic bodies 12*a* and 12*b*, two voice coil plates 13*a* and 13*b*, a pair of vibration-lead plates 14*a* and 14*b*, a diaphragm 15, and a damper 16.

The base frame 11 forms an outward appearance of the flat-type speaker. One pair of the magnetic bodies 12*a* with different polarities is horizontally arrayed at a specific interval and the other pair of the magnetic bodies 12*b* with different polarities is horizontally arrayed at a specific interval within the base frame 11.

The one pair of magnetic bodies 12*a* and the other pair of magnetic bodies 12*b* are horizontally arrayed in a vertical direction.

The voice coil plates 13*a* and 13*b*, each having a voice coil pattern-printed or spirally wound on a single side or both sides thereof, are placed between the one pair of magnetic bodies 12*a* and the other pair of magnetic bodies 12*b*.

The pair of vibration-lead plates 14*a* and 14*b* is placed at the top of the two voice coil plates 13*a* and 13*b*, and the damper 16 for assisting the vibration of the voice coil plates is placed at the bottom of the two voice coil plates 13*a* and 13*b*.

The pair of vibration-lead plates 14*a* and 14*b* is electrically connect to the + and − lead lines of the voice coil plates 13*a* and 13*b*, power source terminals are formed at four places on both ends of the pair of vibration-lead plates 14*a* and 14*b*, and terminal blocks for being applied with an external power source are formed at four places on both ends of the base frame 11.

The diaphragm 15 is placed at the top of the pair of vibration-lead plates 14*a* and 14*b*, and the vibration-lead plates 14*a* and 14*b* and the diaphragm 15 are brought in surface-to-surface contact with each other. Through the surface-to-surface contact, more sound energy is transferred to the diaphragm 15.

In such a structure, when an external power source is applied through the power source terminals of the vibration-lead plates 14*a* and 14*b*, current flows through the voice coils formed on the voice coil plates 13*a* and 13*b*. Here, the current generates a magnetic field that is expanded and contracted in the same frequency as that of an audio signal around the voice coils.

Since a magnetic field generated from the magnetic bodies 12*a* and 12*b* of the flat-type speaker is applied to the voice coils, the magnetic field interacts with the magnetic field generated from the voice coils, with the result that the voice coil plates 13*a* and 13*b* are vibrated up and down. Since the voice coil plates 13*a* and 13*b* are connected to the diaphragm 15 of the flat-type speaker by the vibration-lead plates 14*a* and 14*b*, the diaphragm 15 is vibrated up and down, thus pushing air. As a result, sounds are generated by the vibration of the air.

The flat-type speaker needs to have an improved structure with small output of 2 W to high-capacity output in the future. A flat-type speaker having the high-capacity output inevitably has a long and slim length or has only a large width without a change of the length.

Accordingly, the structure of a speaker that complies with the high-output speaker of a flat-type speaker inevitably having only a large width without a change of the length is disclosed by the present invention.

In the present invention, in order to propose a high-output speaker, there is proposed a structure configured to have two or more magnetic circuits horizontally connected, wherein vibration-lead plates are formed for an electrical connection between the magnetic circuits and electrically connected to voice coil plates and the vibration-lead plates, together with the voice coil plates, are brought in surface-to-surface contact with a diaphragm on the upper side so as to maximize the transfer of sound energy to the diaphragm.

Figure 2:
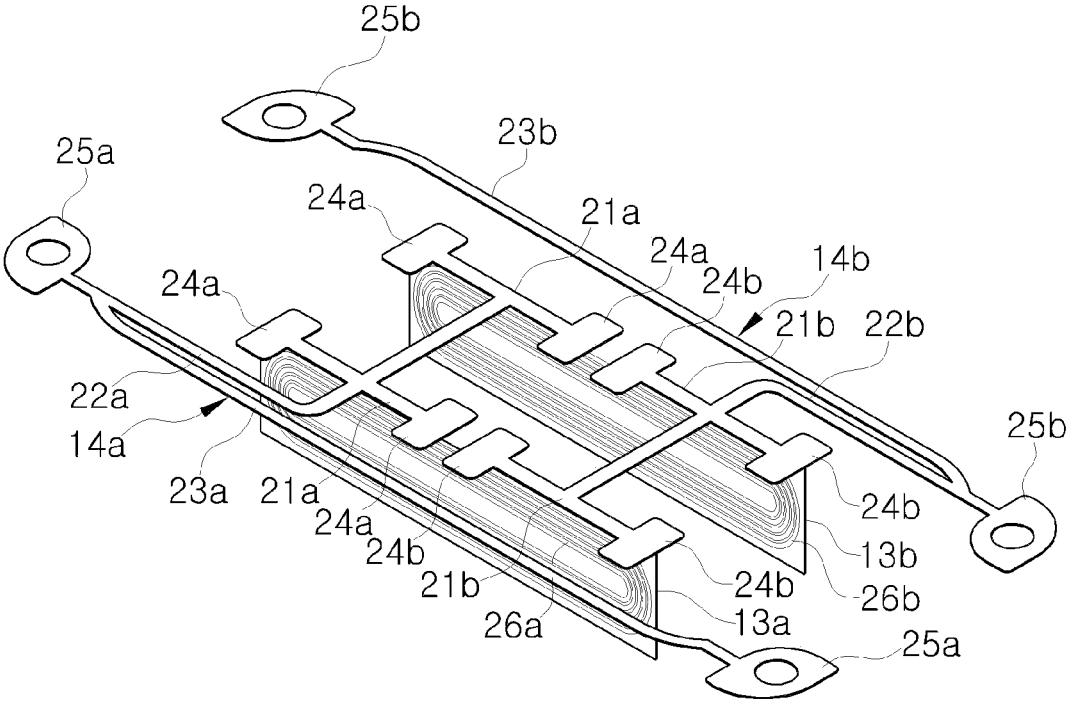
FIG. 2 is a perspective view illustrating the parallel connection of the plurality of magnetic circuits and the structure of a vibration-lead plate of FIG. 1.

FIG. 2 is a perspective view illustrating the parallel connection of a plurality of magnetic circuits and the structure of the vibration-lead plate of FIG. 1.

As shown in FIG. 2, a pair of the vibration-lead plates 14*a* and 14*b* is formed, and two voice coil plates 13*a* and 13*b* are horizontally arrayed in a vertical direction.

The voice coil plates 13*a* and 13*b* may continue to be horizontally added in a vertical direction in order to further increase the output capacity of the speaker, but only the length of the vibration-lead plates 14*a* and 14*b* and the structure of the splines of the vibration-lead plates 14*a* and 14*b* are changed and the number of vibration-lead plates 14*a* and 14*b* may be one pair.

Various types of splines that form the vibration-lead plates 14*a* and 14*b*, described in this specification, mean slim and long thin plates made of metal as a dictionary meaning.

The voice coil plates 13*a* and 13*b* include respective voice coils 26*a* and 26*b* each pattern-printed in a track form. Each of the voice coils 26*a* and 26*b* is printed on both sides of each of the voice coil plates 13*a* and 13*b*.

The + and − lead lines of the voice coils 26*a* and 26*b* are electrically connected to the respective vibration-lead plates 14*a* and 14*b*.

The vibration-lead plates 14*a* and 14*b* include respective contact splines 21*a* and 21*b*, each having one or more connection terminals 24*a* and 24*b* electrically connected to the voice coils 26*a* and 26*b*, respective vibration splines 23*a* and 23*b* brought in surface-to-surface contact with the diaphragm 15 on the upper side, and respective wing splines 22*a* and 22*b* connecting the contact splines 21*a* and 21*b* and the vibration splines 23*a* and 23*b*. Power source terminals 25*a* and 25*b* connected to an external power source are formed at four places on both sides of the vibration-lead plates 14*a* and 14*b*.

The pair of vibration-lead plates 14*a* and 14*b* is symmetrical to each other, rotated 180 degrees, and mounted on the basis of one of the pair of vibration-lead plates 14*a* and 14*b*. It will be preferred that the two vibration-lead plates 14*a* and 14*b* be fabricated to have the same structure in order to increase productivity efficiency.

One lead line of the voice coil 26*a* is connected to one terminal (+ terminal) of the connection terminal 24*a* of the vibration-lead plate 14*a*, and the other lead line of the voice coil 26*a* is connected to one terminal (− terminal) of the connection terminal 24*b* of the vibration-lead plate 14*b*.

Likewise, one lead line of the voice coil 26*b* is connected to one terminal (+ terminal) of the connection terminal 24*a* of the vibration-lead plate 14*a*, and the other lead line of the voice coil 26*b* is connected to one terminal (− terminal) of the connection terminal 24*b* of the vibration-lead plate 14*b*.

The two voice coils (magnetic circuits) connected as described above have an electrically parallel connection structure.

The connection terminals 24*a* and 24*b* are connected to the power source terminals 25*a* and 25*b* through the wing splines 22*a* and 22*b*.

The wing splines 22*a* and 22*b* play as media for an electrical connection between the power source terminals 25*a* and 25*b* and the connection terminals 24*a* and 24*b*. Furthermore, the wing splines 22*a* and 22*b* are connected to the contact splines 21*a* and 21*b* and the vibration splines 23*a* and 23*b* play as damper bridges for increasing vibration energy of the vibration splines 23*a* and 23*b*.

The vibration splines 23*a* and 23*b* are brought in surface-to-surface contact with the diaphragm 15 on the upper side so that vibration energy can be efficiently transferred to the diaphragm 15.

As a result, the vibration-lead plates 14*a* and 14*b* are mounted on the bottom of the diaphragm 15 in a surface manner so that they vibrate more vibration energy along with the diaphragm so as to maximize sound energy output. Furthermore, the + and − terminals are formed at both ends of the vibration-lead plates 14*a* and 14*b*, and the vibration-lead plates 14*a* and 14*b* are formed of metal plates. Accordingly, a soldering connection using existing lead lines (silver lines) used for a circuit connection with the voice coils is obviated, and a failure attributable to the breakage of the lead lines is obviated and a difficulty in the process is solved by replacing the role of the lead lines with the metal plates.

Figure 3:
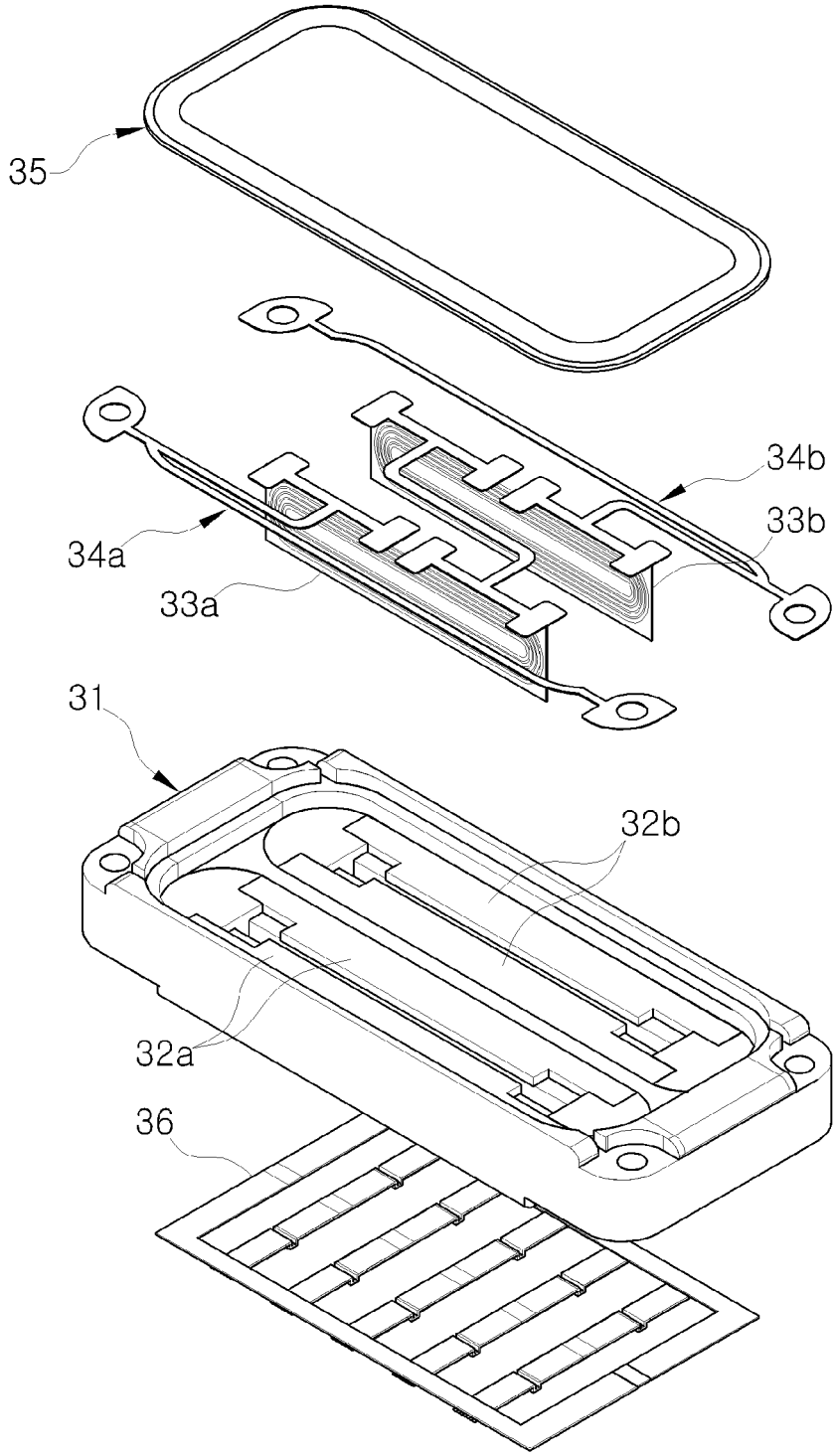
FIG. 3 is an exploded perspective view showing a serial connection structure of a flat-type speaker in which a plurality of magnetic circuits is horizontally connected in accordance with a second embodiment of the present invention.
Figure 4:
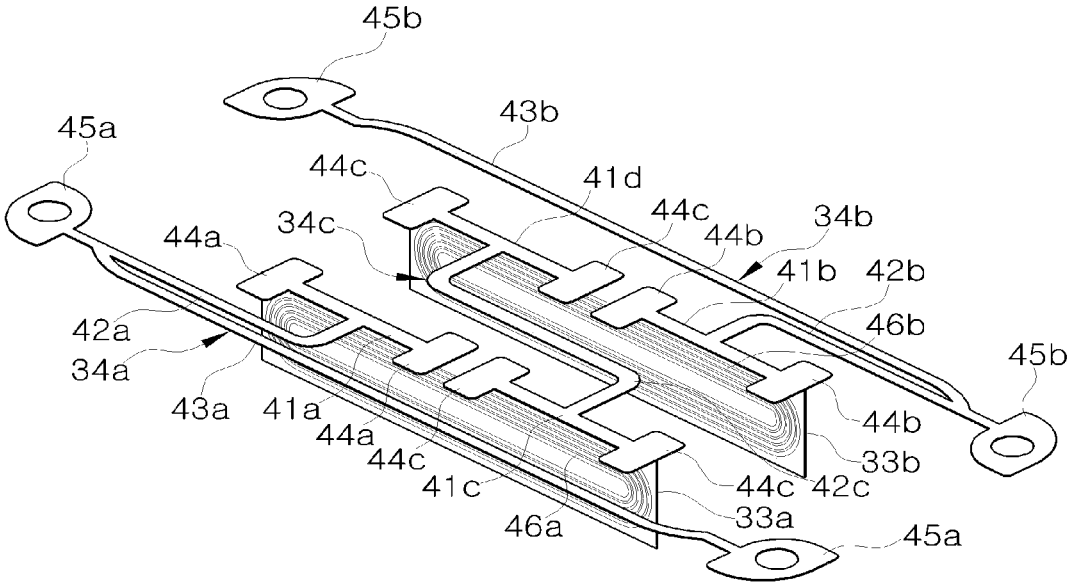
FIG. 4 is a perspective view illustrating the serial connection of the plurality of magnetic circuits and the structure of a vibration-lead plate of FIG. 3.

A serial connection structure of a flat-type speaker in which a plurality of magnetic circuits is horizontally connected FIG. 3 is an exploded perspective view showing a serial connection structure of a flat-type speaker in which a plurality of magnetic circuits is horizontally connected in accordance with a second embodiment of the present invention, and FIG. 4 is a perspective view illustrating the serial connection of the plurality of magnetic circuits and the structure of a vibration-lead plate of FIG. 3.

As shown in FIG. 3, the flat-type speaker in accordance with the second embodiment of the present invention is configured to include a base frame 31, magnetic bodies 32*a* and 32*b*, two voice coil plates 33*a* and 33*b*, a pair of vibration-lead plates 34*a* and 34*b*, a diaphragm 35, and a damper 36.

The second embodiment of the present invention shown in FIG. 3 has the same construction as the first embodiment, and the structure of the vibration-lead plates and a connection structure between the vibration-lead plates and voice coils in the second embodiment are different from those in the second embodiment and are described below.

As shown in FIG. 4, a pair of the vibration-lead plates 34*a* and 34*b* is formed, and two voice coil plates 33*a* and 33*b* are horizontally arranged in a vertical direction.

The voice coil plates 33*a* and 33*b* include respective voice coils 46*a* and 46*b* pattern-printed in a track form, and the voice coils 46*a* and 46*b* are printed on both sides of the respective voice coil plates 33*a* and 33*b*.

The + and − lead lines of the voice coils 46*a* and 46*b* are electrically connected to the respective vibration-lead plates 34*a* and 34*b*.

The vibration-lead plate 34 is configured to include a pair of vibration-lead plates 34*a* and 34*b* and a connection lead plate 34*c* electrically connecting the pair of vibration-lead plates 34*a* and 34*b* in series.

The pair of vibration-lead plates 34*a* and 34*b* include respective contact splines 41*a* and 41*b*, each having one or more connection terminals 44*a* and 44*b* electrically connected to the voice coils 46*a* and 46*b*, respective vibration splines 43*a* and 43*b* brought in surface-to-surface contact with the diaphragm 15 placed on the upper side, and respective wing splines 42*a* and 42*b* connecting the contact splines 41*a* and 41*b* and the vibration splines 43*a* and 43*b*. Power source terminals 45*a* and 45*b* connected to an external power source are formed at four places on both sides of the pair of vibration-lead plates 34*a* and 34*b*.

The pair of vibration-lead plates 44*a* and 44*b* is symmetrical to each other, rotated 180 degrees, and mounted on the basis of one of the pair of vibration-lead plates 44*a* and 44*b*. The two vibration-lead plates 44*a* and 44*b* have the same structure in order to increase assembly production efficiency.

Furthermore, the connection lead plate 34*c* includes a first serial contact spline 41*c* having one or more connection terminal 44*c* for a serial connection with the two voice coils 46*a* and 46*b* and brought in contact with the voice coil plate 33*a*, a second serial contact spline 41*d* having one or more connection terminals 44*c* and brought in contact with the voice coil plate 33*b*, and a bridge spline 42*c* connecting the two contact splines 41*c* and 41*d*.

One lead line of the voice coil 46*a* is connected to one terminal (+ terminal) of the connection terminal 44*a* of the vibration-lead plate 34*a*, and the other lead line of the voice coil 46*a* is connected to one terminal of the connection terminal 44*c* that belongs to the first serial contact spline 41*c* of the connection lead plate 34*c*.

Likewise, one lead line of the voice coil 46*b* is connected to one terminal of the connection terminal 44*c* that belongs to the second serial contact spline 41*d* of the connection lead plate 34*c*, and the other lead line of the voice coil 46*b* is connected to one terminal (– terminal) of the connection terminal 44*b* of the vibration-lead plate 34*b*.

The two voice coils (magnetic circuits) connected as described above have a structure in which the (+) power source terminals-the first coil-the first serial contact spline-the second serial contact spline-the second coil-the (–) terminal are electrically connected in series.

The wing splines 42*a* and 42*b* play as media for an electrical connection between the power source terminals 45*a* and 45*b* and the connection terminals 44*a* to 44*d*. Furthermore, the wing splines 42*a* and 42*b* are connected to the contact splines 41*a* and 41*b* and the vibration splines 43*a* and 43*b* and play as damper bridges for increasing vibration energy of the vibration splines 43*a* and 43*b*.

The vibration splines 43*a* and 43*b* are brought in surface-to-surface contact with the diaphragm 35 on the upper side so that vibration energy can be efficiently transferred to the diaphragm 35.

Figure 5:
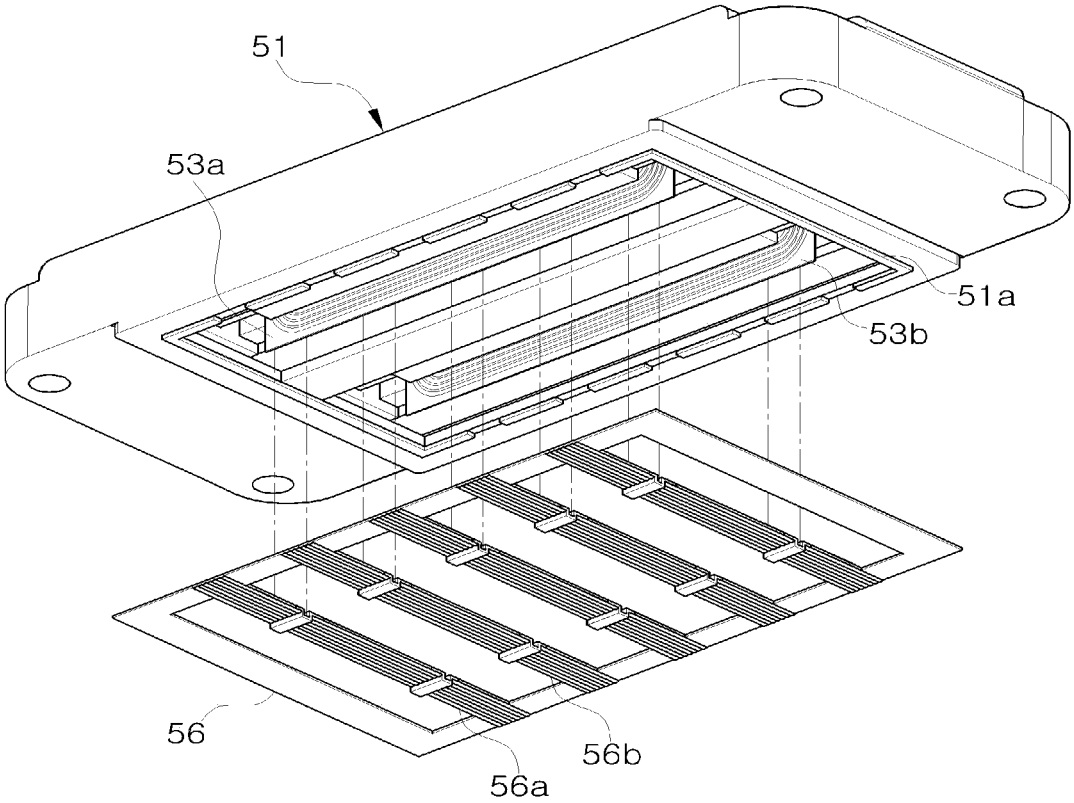
FIG. 5 is a perspective view showing the connection structure of the base frame, voice coil plates, and damper of a flat-type speaker in which a plurality of magnetic circuits is horizontally connected according to the present invention.

FIG. 5 is a perspective view showing the connection structure of the base frame, voice coil plates, and damper of a flat-type speaker in which a plurality of magnetic circuits is consecutively connected according to the present invention.

If two or more voice coil plates are horizontally connected in a vertical direction, a very important factor is to maintain the right position of the voice coil plates in order to prevent biased vibration due to an increased width of a speaker. A damper 56 is used to precisely maintain the right positions of the voice coil plate or assist the vibration of the voice coil plates as described above.

The damper 56 has a rectangular form and includes a plurality of damper bridges 56*a* formed therein. Seating portions 56*b* into which voice coil plates 53*a* and 53*b* are inserted and seated are formed at the centers of the damper bridges 56*a*. The four sides of the damper 56 are precisely positioned at a damper guide 51*a* formed in the outskirt at the bottom of a base frame 51.

The connection structure of the base frame, the voice coil plates, and the damper of FIG. 5 can be identically applied to the embodiments shown in FIGS. 1 to 4.

Figure 6:
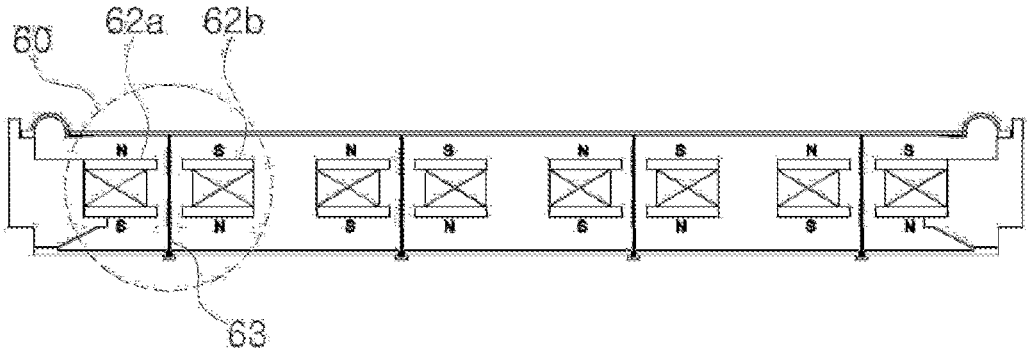
FIG. 6 shows a basic array structure of the polarity of a magnet and a voice coil plate in a flat-type speaker in which a plurality of magnetic circuits is horizontally connected according to the present invention.
Figure 7:
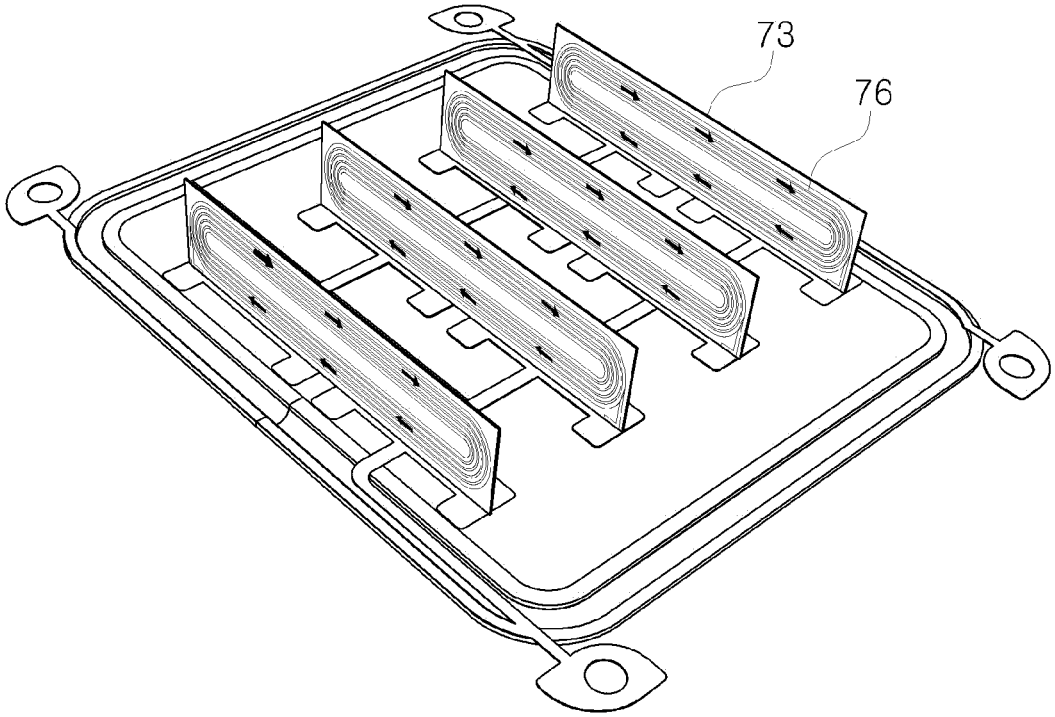
FIG. 7 shows a current flow of the voice coil plate according to the structure of FIG. 6.

FIG. 6 shows a basic array structure of the polarity of a magnet and a voice coil plate in a flat-type speaker in which a plurality of magnetic circuits is horizontally connected according to the present invention, and FIG. 7 shows a current flow of the voice coil plate according to the structure of FIG. 6.

The flat-type speaker of the present invention described with reference to FIGS. 1 to 5 has a structure in which a voice coil plate is inserted between a pair of independent magnetic bodies with different polarities and the voice coil plate and the pair of independent magnetic bodies are horizontally connected.

FIG. 6 shows a state in which a plurality of magnetic circuits 60 having one voice coil plate 63 inserted between a pair of magnetic bodies 62*a* and 62*b* is horizontally connected.

The pair of magnetic bodies 62*a* and 62*b* into which the voice coil plate 63 is inserted has different polarities, and each of the magnetic circuits 60 forms the same magnetic circuit.

A flat-type speaker in which a plurality of magnetic circuits having a plurality of magnetic circuits, such as that shown in FIG. 6, is horizontally connected shows a current flow, such as that of FIG. 7.

That is, referring to FIG. 7, current that flows into the voice coils 76 of respective voice coil plates 73 has the same direction (an arrow direction or a direction opposite an arrow).

To set the polarities of independent magnetic bodies, a plurality of voice coil plates, and magnets as in FIG. 6 so that current flowing into the voice coils of the voice coil plates placed in the magnetic bodies has the same direction is an essential condition for configuring a plurality of magnetic circuits in series or in parallel by connecting the plurality of magnetic circuits horizontally.

Accordingly, if a voice coil plate is inserted between magnetic bodies as in the prior art, current that flows into the voice coil of an adjacent voice coil plate flows in an opposite direction. In such a structure, it is difficult to form a serial or parallel connection structure of the voice coil plates. As a result, it is difficult to freely implement a high-output flat-type speaker in which a plurality of magnetic circuits is horizontally connected.

Although the preferred embodiments of the present invention have been described with reference to the accompanying drawings, those skilled in the art to which the present invention pertains will understand that the technical construction of the present invention may be implemented in other detailed forms without changing the technical spirit or essential characteristics of the present invention. Therefore, it should be understood that the above-described embodiments are not limitative, but are illustrative from all aspects. The scope of the present invention is defined by the appended claims rather than the detailed description, and the present invention should be construed as covering all modifications or variations derived from the meaning and scope of the appended claims and equivalents thereof.

The invention claimed is:

1. A flat-type speaker, comprising:

a plurality of magnetic circuits;

wherein the plurality of magnetic circuits are horizontally connected;

two or more pairs of independent magnetic bodies with different polarities being horizontally connected;

each of two or more voice coil plates having voice coils printed thereon and being horizontally arrayed between the magnetic bodies in a vertical direction in the two or more magnetic bodies;

wherein the two or more voice coil plates maintain an identical current flow direction;

two or more vibration-lead plates of a slim and thin film shape being electrically separated from each other and placed on top of the two or more voice coil plates;

wherein the voice coils and the two or more vibration-lead plates are electrically connected;

wherein the two or more vibration-lead plates comprise contact splines electrically connected to respective voice coils in response to the two or more voice coil plates; and a bridge spline interconnecting the contact splines.

2. The flat-type speaker according to claim 1, further comprising power source terminals for applying a power source and which are formed at both ends of the two or more vibration-lead plates.

3. The flat-type speaker of claim 1, wherein:

the two or more vibration-lead plates further comprise a vibration spline brought into surface-to-surface contact with a diaphragm placed on an upper side of the vibration-lead plates, and a wing spline interconnecting the contact spline and the vibration spline.

4. The flat-type speaker of claim 1, wherein the two or more vibration-lead plates further comprise vibration splines brought into surface-to-surface contact with a diaphragm placed on an upper side of the vibration-lead plates, and wing splines interconnecting the contact splines and the vibration splines.

5. The flat-type speaker of claim 1, wherein:

the plurality of magnetic circuits is consecutively connected and further comprises one or more connection lead plates; vibration splines brought into surface-to-surface contact with a diaphragm placed on an upper side of the two or more vibration-lead plates, and wing splines interconnecting the contact splines and the vibration splines; and the contact splines further comprise a first serial contact spline electrically connected to the voice coil of one voice coil plate and a second serial contact spline electrically connected to another voice coil plate adjacent to the one voice coil plate, wherein the bridge spline interconnects the first and the second serial contact splines.

6. The flat-type speaker of claim 1, wherein a connection terminal of a copper thin plate form is formed at a portion where the two or more vibration-lead plates and the voice coils are electrically connected.

7. The flat-type speaker of claim 1, wherein:

a bottom of the two or more voice coil plates is mounted on seating portions placed in a vertical central part of a rectangular damper, and an outskirt of the damper is mounted on a damper guide formed at an outskirt of a bottom of a base frame that form an outward appearance.

8. A flat-type speaker, comprising:

a plurality of magnetic circuits;

wherein the plurality of magnetic circuits are horizontally connected;

two or more pairs of independent magnetic bodies with different polarities being horizontally connected;

each of two or more voice coil plates having voice coils printed thereon and being horizontally arrayed between the magnetic bodies in a vertical direction in the two or more magnetic bodies;

wherein the two or more voice coil plates maintain an identical current flow direction;

two or more vibration-lead plates of a slim and thin film shape being electrically separated from each other and placed on top of the two or more voice coil plates;

wherein the voice coils and the two or more vibration-lead plates are electrically connected;

wherein the plurality of magnetic circuits is consecutively connected and further comprises one or more connection lead plates;

vibration splines brought into surface-to-surface contact with a diaphragm placed on an upper side of the two or more vibration-lead plates, and wing splines interconnecting contact splines and vibration splines; and the contact splines further comprise a first serial contact spline electrically connected to the voice coil of one voice coil plate and a second serial contact spline electrically connected to another voice coil plate adjacent to the one voice coil plate, wherein the bridge spline interconnects the first and the second serial contact splines.

9. The flat-type speaker according to claim 8, further comprising power source terminals for applying a power source and which are formed at both ends of the two or more vibration-lead plates.

10. The flat-type speaker of claim 8, wherein a connection terminal of a copper thin plate form is formed at a portion where the two or more vibration-lead plates and the voice coils are electrically connected.

11. The flat-type speaker of claim 8, wherein:

a bottom of the two or more voice coil plates is mounted on seating portions placed in a vertical central part of a rectangular damper, and an outskirt of the damper is mounted on a damper guide formed at an outskirt of a bottom of a base frame that form an outward appearance.

* * * * *